United States Patent [19]

Arendt et al.

[11] 4,119,437

[45] Oct. 10, 1978

[54] METHOD FOR REMOVING $Y_2O_3$ OR $SM_2O_3$ CORES FROM CASTINGS

[75] Inventors: Ronald H. Arendt; Irvin C. Huseby; Marcus P. Borom, all of Schenectady, N.Y.

[73] Assignee: General Electric Company, Schenectady, N.Y.

[21] Appl. No.: 775,753

[22] Filed: Mar. 9, 1977

[51] Int. Cl.[2] ..... B08B 3/08; B08B 7/04

[52] U.S. Cl. ..... 134/3; 134/10; 134/28; 134/30; 134/41; 164/131; 164/132; 423/21

[58] Field of Search ..... 134/3, 22 R, 28, 41, 134/10, 30; 164/34, 35, 36, 132, 131; 423/21, 658.5

[56] References Cited

U.S. PATENT DOCUMENTS

| | | | |
|---|---|---|---|
| 3,694,264 | 9/1972 | Weinland et al. | 164/132 X |
| 3,727,670 | 4/1973 | Bailey | 164/132 |
| 4,043,377 | 8/1977 | Mazdiyasni | 164/132 X |
| 4,043,381 | 8/1977 | Mazdiyasni et al. | 164/132 X |

*Primary Examiner*—Marc L. Caroff

*Attorney, Agent, or Firm*—Donald M. Winegar; Joseph T. Cohen; Charles T. Watts

[57] ABSTRACT

A weakly acid solution of either $NH_4NO_3$, $NH_4Cl$, $NH_4HSO_4$, $CH_3COOH$ or equimolar $CH_3COOH$ — $CH_3COONa$ is employed to remove cores of either $Y_2O_3$ or $Sm_2O_3$ from castings of advanced superalloy materials. A molten salt bath may be used thereafter to remove reaction products formed by the reaction of the materials of the core and the metal casting.

22 Claims, No Drawings

METHOD FOR REMOVING $Y_2O_3$ OR $SM_2O_3$ CORES FROM CASTINGS

BACKGROUND OF THE INVENTION

1. Field of the Invention

This invention relates to a method for leaching cores made of either $Y_2O_3$ or $Sm_2O_3$ from castings of advanced super-alloy materials.

2. Background of the Invention

Some gas turbine blades and vanes contain internal passages for the circulation of air therethrough. These passages are of such complexity that casting is the only feasible means of their fabrication.

The selection of the core and mold materials for use in the casting operation is dictated by two considerations. First, the core and the mold materials must be thermodynamically stable against interaction with the molten alloy components, in particular carbon in the instance of advanced superalloys like NiTaC-13. The reaction of carbon in the molten alloy with an oxide core and/or mold material could lead to the formation of CO or $CO_2$ filled bubbles in the solidified structure, which is a very undesirable situation. The second consideration applies primarily to the selection of the core material. Because of the web-like nature of the internal cooling air passages, the core material must be dissolved away chemically without damage to the surrounding alloy structure. The core material, a ceramic, must therefore be chemically labile toward aqueous solutions which will not affect the alloy. This condition of lability requires that the core materials not contain materials such as $Al_2O_3$, $ThO_2$, $ZrO_2$ or $SiO_2$ and the like since these compounds generally require strongly acidic media, such as HF, for their rapid dissolution. The alloy would most likely dissolve at a higher rate than the core under these conditions.

It is therefore an object of this invention to provide a new and improved method for removing core material from castings of advanced superalloy materials without deleteriously affecting the finish and material of the casting.

Another object of this invention is to provide an aqueous solution of a weak acid to remove core materials from the castings of advanced superalloy materials.

Other objects of this invention will, in part, be obvious and will, in part, appear hereinafter.

BRIEF DESCRIPTION OF THE INVENTION

In accordance with the teachings of this invention there is provided a new and improved method for removing core materials of either $Y_2O_3$ or $Sm_2O_3$ from castings of advanced superalloy materials such as NiTaC-13. The method includes the use of heated aqueous solutions of weak acids. Suitable weak acid materials are $NH_4NO_3$, $CH_3COOH$ and equimolar $CH_3COOH$ — $CH_3COONa$. The nitrates, sulfates or acetates resulting from the use of the corresponding weak acids may be heated to about 800° C. to regenerate the ceramic oxide.

Solutions of $CH_3COOH$ having a molarity of from 5 to about 15 may be employed when heated from about 50° C. to about 100° C. When the advanced superalloy material is NiTaC-13 and the core material is $Y_2O_3$, the minimum temperature of the leaching bath solution is about 60° C.

A reaction between the core material and the advanced superalloy material may occur during casting and remain after leaching by the hot weak acid solution. A molten salt bath may then be employed to remove any remaining reaction product material.

DESCRIPTION OF THE INVENTION

Yttria, $Y_2O_3$, and samarium oxide, $Sm_2O_3$, have been found to be suitable materials for making ceramic articles useful in the casting and directional solidification of advanced superalloy materials such as NiTaC-13. In particular, each has been found to be suitable for making cores for castings.

Each of the materials $Y_2O_3$ and $Sm_2O_3$ may be purchased in a desired particle size and used as purchased. Otherwise, the material is placed in a crucible, melted and fusion cast. The fusion cast material is then crushed and ground to a desired particle size. In making cores for gas turbine blades, the desired particle size ranges from about 10 microns to about 150 microns.

The cores are made by depositing a predetermined amount of material in a mold, without a binder, and pressing the material into a desired configuration for the core. Thereafter, the pressed core is sintered to provide the strength necessary for handling and retaining the shape during casting and solidification of the cast melt. The cores made of $Y_2O_3$ are sintered at a temperature of from about 1500° C. to about 1900° C.

The density of the material of the core, after sintering, is from about 40 percent to 90 percent. This provides a porosity content of from about 60 percent by volume down to about 10 percent by volume. A porosity content of at least about 10 percent by volume is desired in order to assure that at least some of the pores are interconnected. The desired range of porosity content is chosen to enable the leaching solution to permeate the core material as easily as possible and to expose as large a surface area as possible to attack by the leaching solution.

Samples of each of the materials, $Y_2O_3$ and $Sm_2O_3$, were prepared and, after sintering, had a porosity content of about 20 percent by volume. A sensile drop test was performed on each in flowing argon at 1800° C. ± 25° C. for 1 hour. The advanced superalloy material employed in the test was NiTaC-13. No reaction was observed between the $Y_2O_3$ and the NiTaC-13 at the interface thereof. There appeared to be a slight reaction between the $Sm_2O_3$ and the NiTaC-13 at the interface thereof which may limit the use of $Sm_2O_3$ to those instances where a high degree of surface finish is required. Core samples of each material were prepared. Each of the cores were exposed to a melt of NiTaC-13 for 20 hours to simulate casting and directional solidification. An examination of the metal surface at the core-metal interface showed a slight reaction between the metal and $Y_2O_3$. However, the surface finish was still acceptable for most commercial uses. For uses requiring a greater degree of surface finishing some further surface machining operation will be required but should still be economically feasible for the end product. In the instance of $Sm_2O_3$, it appears that the material is more reactive to NiTaC-13 than is desirable. Therefore, one might have to limit its exposure time at 1700° C. to an advanced superalloy material to no greater than about four hours.

In-place leaching of the core materials or core dissolution is accomplished using aqueous solutions of weak acids. Suitable solutions are ammonium nitrate, $NH_4NO_3$, ammonium chloride, NHCl, ammonium hydrogen sulfate, $NH_4HSO_4$, acetic acid, $CH_3COOH$, and equimolar acetic acid-sodium acetate, $CH_3COOH—CH_3COONa$. $NH_4NO_3$ in aqueous solutions of from 0.1 molar to saturation and at a temperature of from about 20° C. to about 100° C. is particularly suitable as a leaching solution. The oxides $Y_2O_3$ and $Sm_2O_3$ can be regenerated by heating the resultant nitrates, sulfates or acetates obtained by the leaching action, at a temperature of approximately 800° C. However, the preferred leaching solution is acetic acid.

Several core samples of $Y_2O_3$ having a porosity content of about 20 percent by volume were prepared by pressing and sintering at 1800° C. ± 10° C. for two hours. The cores were employed in molds to cast a melt of NiTaC-13 therein at 1825° C. ± 25° C. and maintained at 1825° C. ± 25° C. for about 30 hours to directionally solidify the metal.

A 5.0 molar solution of acetic acid was prepared and heated to 50° C. ± 1° C. One casting with the core was placed in the heated solution. After 24 hours, the core material had been dissolved to some extent but not enough to warrant a commercial use of the procedure.

A second leaching procedure was followed employing a 5.0 molar solution of acetic acid heated to 80° C.± 1° C. The core material was preferentially attacked by the acetic acid solution. Some of the core-solution interface remained relatively unaltered, whereas other surface areas were observed to etch. Those surface areas that did etch, did so at a rate of from about $7.0 \times 10^{-3}$ cm/hour to about $13.0 \times 10^{-3}$ cm/hour.

A third leaching example was conducted with a 5.0 molar solution of acetic acid heated to 90° C. ± 1° C. using pressed and sintered pellets of $Y_2O_3$ containing approximately 20 percent porosity. The observed leaching rate was about $6 \times 10^{-3}$ cm/hr.

The leaching rate of $Y_2O_3$ increases by an order of magnitude if mineral acids are employed instead of the aforementioned weak acids. But the rate of metal recession becomes unacceptable. Leaching experiments conducted in heated baths at 95° C. to 100° C. of $5NH_2SO_4$ or of 7NHCl yielder leaching rates of $6 \times 10^{-2}$ cm/hr for 80 percent dense $Y_2O_3$. The metal recession rate was approximately $1.8 \times 10^{-3}$ cm/hr. Hot mineral acids, therefore, cannot be utilized for removal of $Y_2O_3$ cores from nickel-base eutectic or conventional superalloys without protecting the alloy in some fashion from attack by the mineral acid leachant.

Repeated experiments indicate that the molarity of the acetic acid may range from about 5 molar to about 15 molar. The range of temperature of the acetic acid leaching solution may range from above about 50° C. up to about 100° C. A preferred range is from above 60° C. to about 100° C.

The relatively variable reactivity may be the result of impurities in the material. However, the experiments indicated that at higher solution temperatures and/or higher solution concentrations, the metal began to be attacked by the acid. To prevent any attack of the metal during leaching, one may have to resort to anodic protection for the metal casting. To remove any reaction product between the metal and the core material formed at the core-metal interface and insoluble in the leaching solution, one may employ a molten salt bath. Suitable salts for the molten baths are $M_3AlF_6$
$M_3AlF_6 + MF$
$M_3AlF_6 + M'F_2$
$M_3AlF_6 + MCl$ where
M = Li, Na, K
M' = Mg, Ca, Ba, Sr.

A particularly suitable molten salt is $Na_3AlF_6$ employed at 1050° C. This is followed by a rinse in a mixture of chloride salts of NaCl, KCl and LiCl. The products of the molten salt treatment is removed by the chloride salt solution. The chloride salts are removed by a water rinse. This series of treatments has provided an acceptable means of rinsing the $Y_2O_3$ core material from the casting and leaving a satisfactory surface finish on the casting at the metal-core interface.

We claim as our invention:

1. A method for in-place leaching of ceramic materials in contact with a casting comprising an advanced superalloy material comprising (a) preparing an aqueous weak acid leaching solution of a weak acid material which is one selected from the group consisting of $NH_4Cl$, $NH_4HSO_4$, $CH_3COOH$ and equimolar $CH_3COOH$ — $CH_3COONa$, wherein the molarity of the solution is from about 0.1 molar to about 15 molar;

(b) heating the solution to a predetermined temperature;

(c) placing an article consisting essentially of a ceramic material which is one selected from the group consisting of $Y_2O_3$ and $Sm_2O_3$ in the heated solution, and (d) preferentially attacking the ceramic material with the heated solution to dissolve at least a part of the ceramic material into the heated solution.

2. The method of claim 1 and further including (e) placing the casting in a molten salt bath comprising a salt of the general formula which is one selected from the group consisting of $M_3AlF_6$, $M_3AlF_6 + MF$, $M_3AlF_6 + M'F_2$ and $M_3AlF_6 + MCl$ wherein M is Li, Na or K, and M' is Mg, Ca, Ba, or Sr, and (f) leaching from the casting any reaction products formed at the ceramic article-casting interface by reaction of the ceramic material with the advanced superalloy material.

3. The method of claim 2 wherein the salt of the molten salt bath is $Na_3AlF_6$.

4. The method of claim 3 including rinsing the casting leached in the molten salt bath in a second molten salt bath of a mixture of chloride salts.

5. The method of claim 4 wherein the chloride salts are NaCl, KCl and LiCl.

6. The method of claim 1 wherein the weak acid material of the leaching solutions is $Ch_3COOH$.

7. The method of claim 6 wherein the temperature of the leaching solution is from about 20° to about 100° C.

8. The method of claim 7 wherein the ceramic material is $Y_2O_3$.

9. The method of claim 7 wherein the preferred range of molarity of the leaching solution is from about 5 to about 15.

10. The method of claim 2 wherein the weak acid material of the leaching solutions is $CH_3COOH$.

11. The method of claim 10 wherein the temperature of the leaching solution is from about 20° to about 100° C.

12. The method of claim 11 wherein the preferred range of molarity of the leaching solution is from about 5 to about 15.

13. A method for in-place leaching of ceramic materials comprising (a) preparing an aqueous weak acid leaching solution of $NH_4NO_3$, wherein the molarity of the $NH_4NO_3$ solution may range from 0.1 molar to saturation;

(b) heating the solution to a predetermined temperature;

(c) placing an article consisting essentially of a ceramic material which is one selected from the group consisting of $Y_2O_3$ and $Sm_2O_3$ in the heated solution;

(d) preferentially attacking the ceramic material to dissolve at least a part of the ceramic material into the heated solution as a nitrate product;

(e) collecting at least the products of the leaching action as nitrates, and (f) heating the collected nitrates at a temperature of approximately 800° C. to convert the nitrates to at least a ceramic oxide.

14. The method of claim 13 wherein the temperature of the leaching solution is from about 20° C. to about 100° C.

15. The method of claim 14 wherein the ceramic weak acid material is $Y_2O_3$.

16. The method of claim 13 wherein the ceramic material is in contact with a casting comprising an advanced superalloy material.

17. The method of claim 16 wherein the temperature of the leaching solution is from about 20° C. to about 100° C.

18. The method of claim 17 wherein the ceramic material is $Y_2O_3$.

19. The method of claim 16 and further including the process steps of placing the leached ceramic article in a molten salt bath comprising a salt of the general formula which is one selected from the group consisting of $M_3AlF_6$, $M_3AlF_6 + MF$, $M_3AlF_6 + M'F_2$ and $M_3AlF_6 + MCl$ wherein M Is Li, Na or K, and M' is Mg, Ca, Ba, or Sr, and leaching from the casting any reaction products formed at the ceramic article-casting interface by reaction of the ceramic material with the advanced superalloy material

20. The method of claim 19 wherein the salt of the molten salt bath is $Na_3AlF_6$.

21. The method of claim 19 including rinsing the casting leached in the molten salt bath in a second molten salt bath of a mixture of chloride salts.

22. The method of claim 21 wherein the chloride salts are NaCl, KCl and LiCl.

* * * * *